US008693911B2

(12) United States Patent
Watanabe et al.

(10) Patent No.: US 8,693,911 B2
(45) Date of Patent: Apr. 8, 2014

(54) IMAGE FORMING APPARATUS, RESISTANCE MEASURING DEVICE OF RECORDING MEDIUM, AND RESISTANCE MEASURING METHOD

(75) Inventors: Mitsutoshi Watanabe, Shizuoka (JP); Masato Ogasawara, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 299 days.

(21) Appl. No.: 13/161,663

(22) Filed: Jun. 16, 2011

(65) Prior Publication Data

US 2011/0311252 A1 Dec. 22, 2011

Related U.S. Application Data

(60) Provisional application No. 61/355,806, filed on Jun. 17, 2010.

(51) Int. Cl.
*G03G 15/20* (2006.01)

(52) U.S. Cl.
USPC ..... 399/68; 399/45; 399/67

(58) Field of Classification Search
USPC ..... 399/16, 23, 45, 67–69
See application file for complete search history.

(56) References Cited

U.S. PATENT DOCUMENTS

2006/0013602 A1* 1/2006 Lee et al. ..... 399/45
2008/0317485 A1* 12/2008 Lee ..... 399/45

* cited by examiner

*Primary Examiner* — Walter L Lindsay, Jr.
*Assistant Examiner* — Jessica L Eley
(74) *Attorney, Agent, or Firm* — Amin, Turocy & Watson, LLP

(57) ABSTRACT

An image forming apparatus according to an embodiment includes: an image carrier; a transfer device which transfers a toner image formed on the image carrier onto a recording medium; a resistance measuring device which causes a current to flow through the recording medium before transferring the toner image and measures the resistance of the recording medium; and a setting unit which sets a condition of the transfer on the basis of the measurement result of the resistance of the recording medium. The resistance measuring device includes an electric shock prevention member which prevents the current from flowing to a user through the recording medium during the measurement of the resistance of the recording medium.

12 Claims, 3 Drawing Sheets

IMAGE FORMING APPARATUS, RESISTANCE MEASURING DEVICE OF RECORDING MEDIUM, AND RESISTANCE MEASURING METHOD

CROSS-REFERENCE TO RELATED APPLICATION

This application is based upon and claims the priority of U.S. Provisional Application No. 61/355,806, filed on Jun. 17, 2010, the entire contents of which are incorporated herein by reference.

FIELD

Embodiments described herein relate to an image forming apparatus that forms an image on a recording medium such as a sheet, and relate to an image forming apparatus that includes a resistance measuring device that measures the resistance of a recording medium and sets a transfer bias according to the measured resistance.

BACKGROUND

In an image forming apparatus such as an electrophotographic copying machine, an image is formed on a recording medium (a sheet or the like) in a cycle of charging, exposure, development, transfer, and the like. For example, the surface of a photoconductive drum is uniformly charged, an electrostatic latent image is formed by illuminating the charged photoconductive drum with a laser beam, and a toner image is formed by developing the electrostatic latent image on the photoconductive drum using a developing device.

The toner image developed on the photoconductive drum is primarily transferred onto an intermediate transfer belt or the like which rotates, and then the toner image is secondarily transferred onto the sheet. The sheet onto which the toner image is transferred is heated by a fixing device, such that the toner image is fixed. The sheet having the toner image fixed is discharged by a transport roller. In addition, in the image forming apparatus, an image can be formed on a sheet supplied from a paper feeding cassette or a sheet that is manually fed.

However, in the image forming apparatus according to the related art, since the resistance of the sheet significantly varies according to grammage (g/m$^2$) temperature, humidity, and the like, the resistance of the sheet is measured before performing the secondary transfer, and the transfer is performed by setting a suitable transfer condition (for example, a transfer bias) according to the measured resistance. In order to measure the resistance of the sheet, a bias roller and an opposing roller are disposed between a power source and the earth, and the resistance of the sheet is measured by interposing the sheet between the bias roller and the opposing roller.

However, when the humidity is high and the sheet is thin, the resistance of the sheet becomes smaller than the resistance of the opposing roller, and therefore a test current may not flow to the opposing roller but flow to the sheet side. In addition, if the sheet touches a user, the current flows to the user through the sheet, so that there is a possibility of the user receiving an electric shock.

DETAILED DESCRIPTION

An image forming apparatus according to an embodiment includes: an image carrier which is illuminated with a laser beam and on which an electrostatic latent image is formed; a charging device which charges the image carrier; a developing device which supplies a developer to the image carrier; a transfer device which transfers a toner image formed on the image carrier by the developing device onto a recording medium; a resistance measuring device which causes a current to flow through the recording medium before transferring the toner image and measures the resistance of the recording medium; a setting unit which sets a condition of the transfer on the basis of the measurement result of the resistance of the recording medium; an electric shock prevention member which prevents the current from flowing to a user through the recording medium during the measurement of the resistance of the recording medium; and a fixing device which fixes the toner image onto the recording medium onto which the toner image is transferred.

Figure 1:
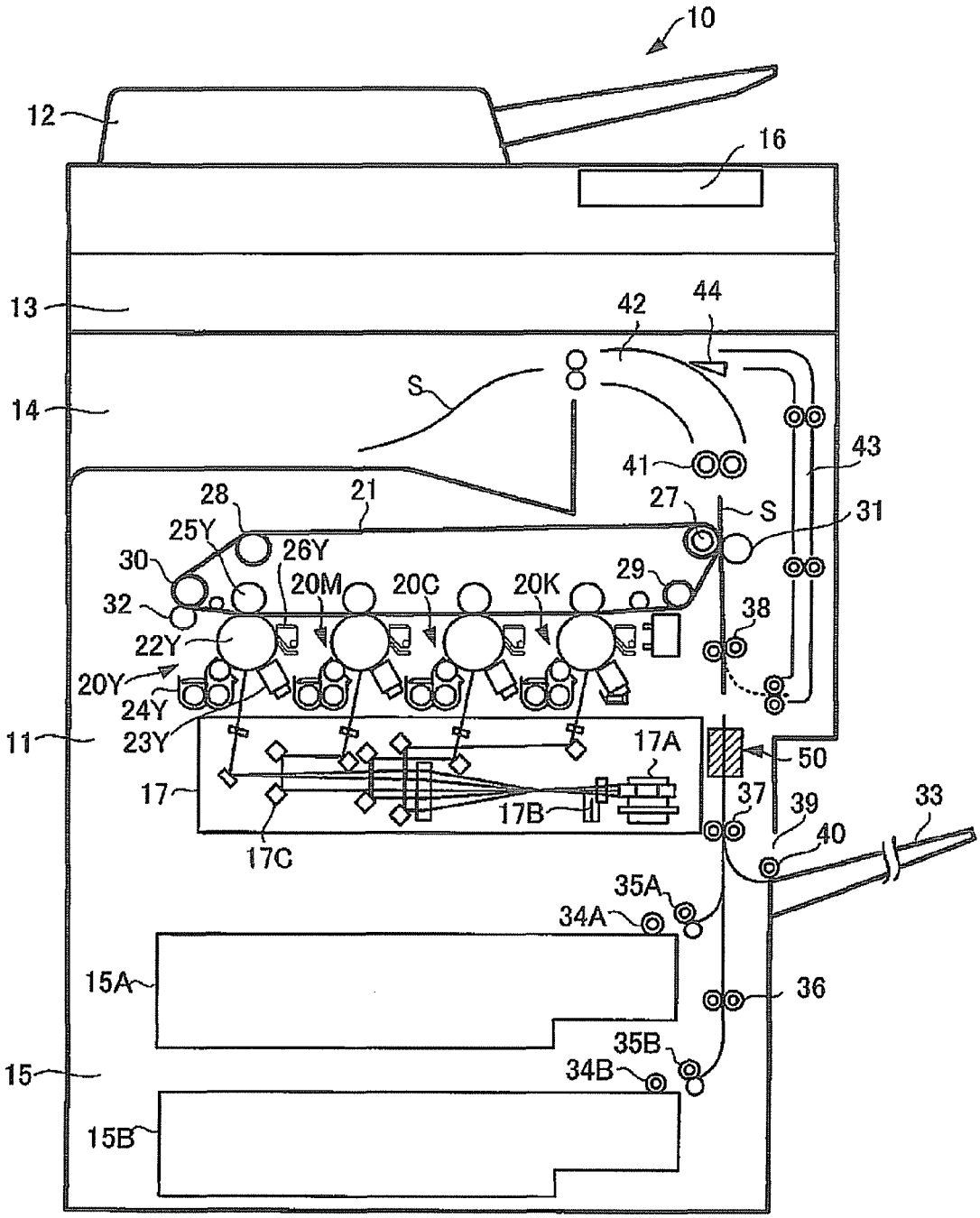
FIG. 1 is a diagram showing the configuration of an image forming apparatus according to an embodiment.

Hereinafter, an image forming apparatus according to a first embodiment will be described with reference to the drawings. In addition, in the drawings, like elements are denoted by like reference numerals. FIG. 1 is a diagram of the internal configuration of the image forming apparatus according to the first embodiment. In the following description, an MFP which is a multi-function peripheral is exemplified. However, the embodiment may also be applied to other image forming apparatuses, such as a printer.

The image forming apparatus 10 includes an image forming unit 11 at the center portion and includes an automatic document feeder (ADF) 12, an image reading unit (scanner) 13, and a paper discharge unit 14 at the upper portion. In addition, a paper feeding unit 15 is provided at the lower portion of the image forming unit 11, and an operation unit 16 including an operation key and a display is provided at the upper portion of the image forming apparatus 10.

The automatic document feeder (ADF) 12 sends an original document to the image reading unit 13, and the image reading unit 13 reads the original document and generates image data. The image forming unit 11 is, for example, a tandem-type color laser printer, and forms an image by scanning photoconductors using laser beams from a laser exposure device 17.

The image forming unit 11 includes image forming sections 20Y, 20M, 20C, and 20K for yellow (Y), magenta (M), cyan (C), and black (K), respectively. The image forming sections 20Y, 20M, 20C, and 20K are disposed in parallel on the lower side of an intermediate transfer belt 21, which is an intermediate transfer medium, from the upstream side to the downstream side.

Moreover, in the following description, reference numerals of elements included in the image forming sections 20Y, 20M, 20C, and 20K have the symbols Y, M, C, and K attached; however, the symbols Y, M, C, and K may be omitted in the description.

Since the image forming sections 20Y, 20M, 20C, and 20K have the same configuration, the image forming section 20Y is described as representative. The image forming section 20Y includes a photoconductive drum 22Y which is an image carrier, and in the periphery of the photoconductive drum 22Y, a charger 23Y, a developing device 24Y, a transfer roller 25Y, a cleaner 26Y, and the like are disposed.

The intermediate transfer belt 21 is circularly moved, and uses, for example, a semiconductive polyimide in terms of heat resistance and wear resistance. The intermediate transfer belt 21 is suspended on a driving roller 27 and driven rollers 28, 29, and 30. The intermediate transfer belt 21 opposes the photoconductive drum 22Y and is able to come in contact therewith. At a position of the intermediate transfer belt 21 opposing the photoconductive drum 22Y, a primary transfer voltage is applied by the transfer roller 25Y, and thus a toner image on the photoconductive drum 22Y is primarily transferred onto the intermediate transfer belt 21.

The driving roller 27 is disposed to oppose a secondary transfer roller 31. When a sheet S passes between the driving roller 27 and the secondary transfer roller 31, a secondary transfer voltage is applied by the secondary transfer roller 31, and thus the toner image on the intermediate transfer belt 21 is secondarily transferred onto the sheet S. In the vicinity of the driven roller 30 of the intermediate transfer belt 21, a belt cleaner 32 is provided.

At an exposure position of the photoconductive drum 22Y, a yellow laser beam is emitted by the laser exposure device 17 to form a latent image on the photoconductive drum 22Y. The charger 23Y uniformly charges the surface of the photoconductive drum 22Y, for example, at about −700 V. The developing device 24Y supplies a two-component developer made of the corresponding color toner and a carrier to the photoconductive drum 22Y using a developing roller to which a developing bias of about −500 V is applied. The cleaner 26Y removes the residual toner on the surface of the photoconductive drum 22Y using a blade.

On the other hand, the laser exposure device 17 scans the photoconductive drum 22Y in an axial direction thereof with the laser beam emitted from a semiconductor laser element, and includes a polygon mirror 17A, an imaging lens system 17B, a mirror 17C, and the like. The paper feeding unit 15 includes a plurality of paper feeding cassettes 15A and 15B that accommodate various sizes of recording media (sheets and the like). A manual tray 33 is included in the image forming apparatus 10 to manually feed a recording medium. In the following description, an example in which an image is formed on a sheet S as a recording medium is described.

On the path from the paper feeding cassettes 15A and 15B to the secondary transfer roller 31, pick-up rollers 34A and 34B that pick up sheets S in the paper feeding cassettes 15A and 15B, separation rollers 35A and 35B, transport rollers 36 and 37, and a registration roller 38 are provided. In addition, in a sheet entrance opening 39 of the manual tray 33, a paper feeding roller 40 is provided.

In addition, a fixing device 41 is provided on the downstream side of the secondary transfer roller 31. A paper discharge transport path 42 from the fixing device 41 to the paper discharge unit 14 is provided, and on the other hand, a reverse transport path 43 is provided. In the reverse transport path 43, a gate 44 is provided to allocate the sheet S to the paper discharge unit 14 side or the reverse transport path 43 side. The reverse transport path 43 reverses the sheet S to be guided to the secondary transfer roller 31 and is used to perform double-sided printing and the like.

In a transport path between the transport roller 37 and the registration roller 38, a resistance measuring device 50 that measures the resistance of the sheet S fed from the paper feeding cassettes 15A and 15B or the manual tray 33 is disposed. The resistance measuring device 50 will be described in detail with reference to FIG. 2.

Next, an operation of the image forming apparatus 10 is simply described. When image information is input from a scanner or a personal computer terminal, yellow (Y), magenta (M), cyan (C), and black (K) toner images are formed by the image forming sections 20Y to 20K, respectively, and the magenta (M), cyan (C), and black (K) toner images are transferred at the same position at which the yellow (Y) toner image is formed on the intermediate transfer belt 21 so as to be overlapped, thereby obtaining a full-color toner image.

The full-color toner image on the intermediate transfer belt 21 is collectively secondarily transferred onto the sheet S by the secondary transfer roller 31. The sheet S is fed to the position of the secondary transfer roller 31 from the paper feeding cassettes 15A and 15B or the manual tray 33. The sheet S onto which the toner image is secondarily transferred is sent to the fixing device 41, and the toner image is fixed onto the sheet S. The sheet S onto which the toner image is fixed is allocated to the paper discharge unit 14 by the gate 44 if the toner image is a single-sided image. When double-sided printing or multiple printing is performed, the sheet S is allocated to the reverse transport path 43 by the gate 44 so as to be re-transported to the secondary transfer roller 31.

On the other hand, the residual toner on the intermediate transfer belt 21 is cleaned by the belt cleaner 32 after the secondary transfer is terminated. In addition, after the toner image on the photoconductive drum 22 is primarily transferred onto the intermediate transfer belt 21, the residual toner on the photoconductive drum 22 is removed by the cleaner 26, so that a subsequent image forming operation can be performed.

However, the image forming apparatus 10 measures the resistance of a sheet before performing secondary transfer on the sheet S and sets a suitable transfer bias according to the measured resistance. Since the resistance of a sheet S significantly varies according to grammage (g/m$^2$), temperature, humidity, and the like, the resistance of the sheet S is measured by the resistance measuring device 50 shown in FIG. 2.

Figure 2:
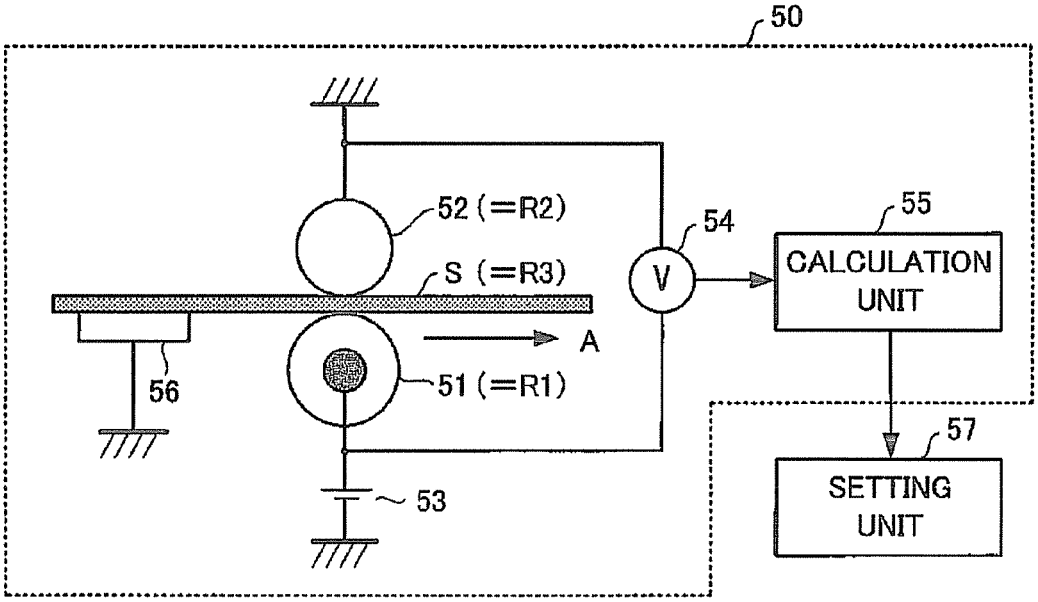
FIG. 2 is a circuit diagram showing a resistance measuring device of a sheet according to the embodiment.

In FIG. 2, the sheet S is transported in the arrow A direction while being interposed between a bias roller 51 and an opposing roller 52. The bias roller 51 is connected to a bias source 53, and the opposing roller 52 is connected to a reference potential point (earth). A constant current flows from the bias source 53 through the bias roller 51 and the opposing roller 52.

In addition, a voltmeter 54 is connected between the bias source 53 and the earth, and the measurement result of the voltmeter 54 is supplied to a calculation unit 55. The calculation unit 55 calculates the resistance of the sheet S and supplies the calculated resistance to a setting unit 57. The setting unit 57 determines a suitable transfer condition (a transfer bias or the like) on the basis of the calculated resistance of the sheet S. The bias roller 51, the opposing roller 52, the bias source 53, and the calculation unit 55 constitute a resistance detecting unit provided in the transport path of the sheet S.

In the resistance measuring device 50 of FIG. 2, first, in a state where no sheet S is present between the bias roller 51 and the opposing roller 52, that is, before a sheet S is transported, a constant current is caused to flow through the bias roller 51 and the opposing roller 52 by the bias source 53. In addition, a voltage between the bias source 53 and the reference potential point is measured by the voltmeter 54. The calculation unit 55 calculates the resistance by dividing the measured voltage by the current (the constant current). For example, assuming that the resistance of the bias roller 51 is R1 and the resistance of the opposing roller 52 is R2, the total resistance R01 between the bias source 53 and the reference potential point is (R1+R2).

Next, when the sheet S is transported between the bias roller 51 and the opposing roller 52, the voltage between the bias source 53 and the reference potential point is measured. By dividing the measured voltage by the current (the constant current), the total resistance R02 between the bias source 53 and the reference potential point can be obtained. Assuming that the resistance of the sheet S is R3, the total resistance R02 is (R1+R2+R3). Therefore, the difference (=R02−R01) between the total resistances R02 and R01 becomes the resistance R3 of the sheet S.

The setting unit 57 determines a suitable transfer bias corresponding to the resistance R3 of the sheet S and applies the transfer bias to a transfer unit (the second transfer roller 31). For example, when the resistance R3 of the sheet S is low, the transfer bias is controlled to be low.

Figure 3:
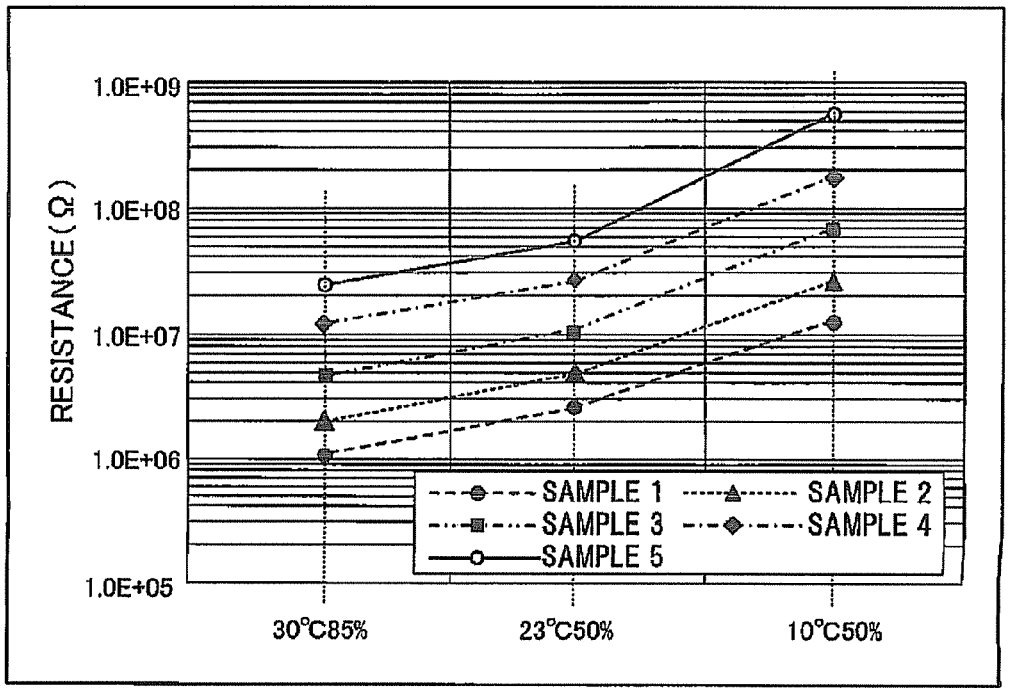
FIG. 3 is a characteristics diagram showing the environmental dependency of a bias roller according to the embodiment.

When the bias roller 51 and the opposing roller 52 are made of the same material and thus the resistances R1 and R2 thereof are equal to each other, the bias roller (or the opposing roller 2) has the environmental dependency characteristics as shown in FIG. 3. FIG. 3 shows changes in resistance that occur when a constant current flows through the bias roller 51 (samples 1 to 5) and temperature and humidity are changed.

As can be seen in FIG. 3, as humidity and temperature are increased, the resistance of the bias roller 51 (or the opposing roller 52) has a tendency to decrease. For example, as a result of measuring a few samples in a range from a temperature of 30° C. and a humidity of 50% to a temperature of 10° C. and a humidity of 20% by causing a constant current of 10 μA to flow, the resistances R1 (or R2) obtained values of (1.0E+06) to (5.0E+08)Ω. Here, (1.0E+06) represents $1.0\times10^{6}$, and (5.0E+08) represents $5.0\times10^{8}$.

Figure 4:
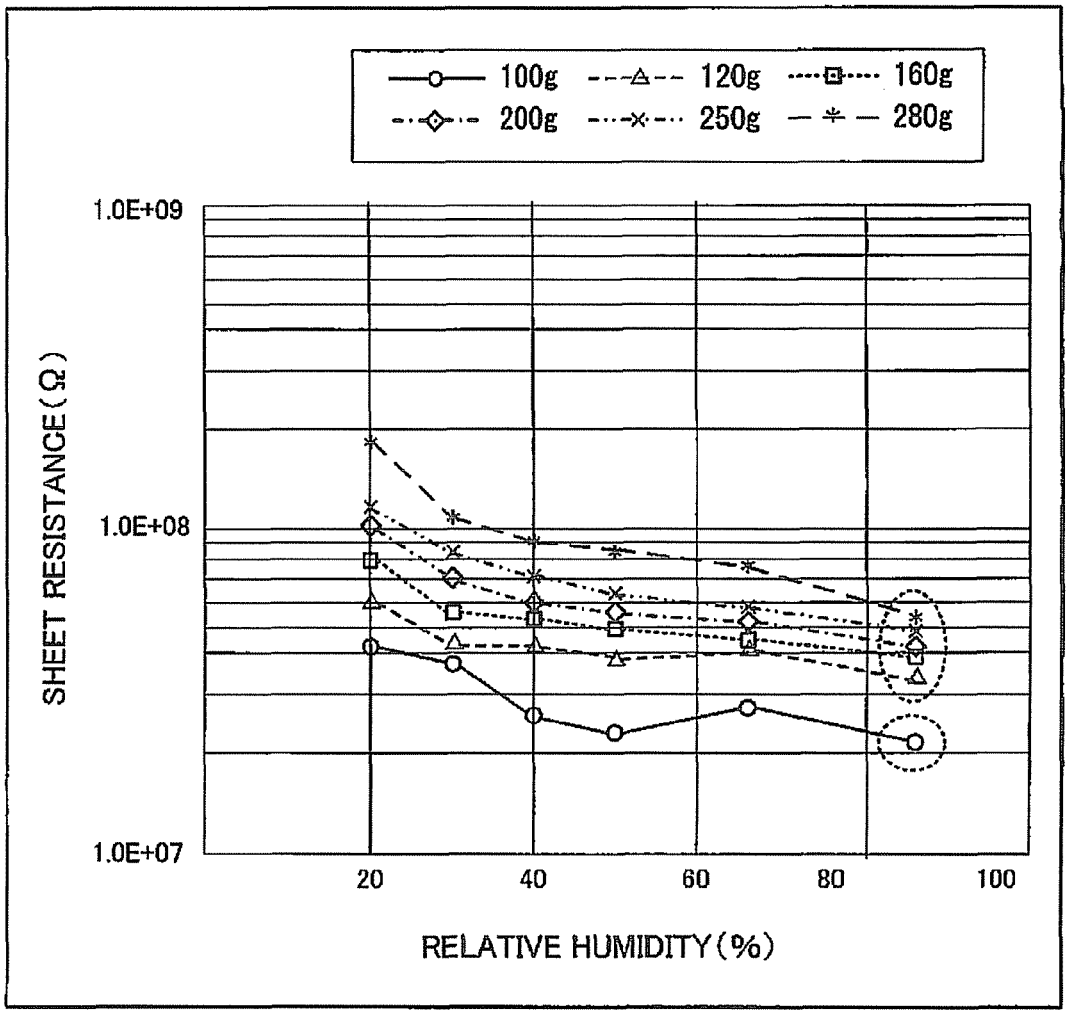
FIG. 4 is a characteristics diagram showing changes in resistance according to types of sheets according to the embodiment.

FIG. 4 shows the environmental dependency characteristics of the sheet S. FIG. 4 shows changes in resistance that occur when the humidity of 6 types of sheets S having different grammages ($g/m^2$) are changed. As can be seen from the characteristics of FIG. 4, when the sheet is thin (has a low grammage) and the humidity is high, the resistance is decreased. For example, when the resistance of a few sheets was measured at a relative humidity of 85%, the resistance R3 of the sheets S had values of (2.0E+07) to (6.0E+07)Ω. That is, depending on the environment, the resistance R3 of the sheet S may become smaller than the resistance R2 of the opposing roller 52.

In a normal state, the resistance R3 of the sheet S is higher than the resistances R1 and R2 of the bias roller 51 (or the opposing roller 52), and thus current flows to a ground point through the opposing roller 52. However, when the resistance R3 of the sheet S becomes lower than the resistance R2 of the opposing roller 52, the current that is to flow to the ground point from the opposing roller 52 flows to the sheet S. Therefore, if the sheet S touches the user, there is concern that the current may flow to the user through the sheet S and the user may receive an electric shock.

In the resistance measuring device 50 according to this embodiment, a guide 56 which is an electric shock prevention member is provided on the upstream side in the sheet transport path so that the guide 56 and the sheet S are in contact with each other, and the guide 56 is grounded. The guide 56 is, for example, a sheet metal.

In addition, the resistance measuring device 50 is disposed on the corner side in the main body from the entrance opening 39 of the manual tray 33 so as not touch the user. For example, assuming that an A4 sheet S is manually fed, the guide 56 of the resistance measuring device 50 is provided at a position 180 mm or more distant from the entrance opening 39 of the manual tray 33. Therefore, if A4 sheets that are frequently used are manually fed, when the manually fed sheet S reaches the guide 56, the sheet S does not touch a user's finger, so that there is no chance of an electric shock.

On the other hand, a long sheet (for example, an A3 sheet) may be manually fed, and there is a possibility that when the resistance of the manually fed sheet S is low, the user may receive an electric shock. Therefore, as the guide 56 is provided at a position that a hand of the user does not reach, current bypasses to the earth via the guide 56 even though the current flows to the sheet S, so that the user does not receive an electric shock.

In addition, when the position of the guide 56 is too close to the bias roller 51, current may flow through the guide 56 even in the normal state. Therefore, the guide 56 is separated by a distance set in advance or further from the bias roller 51 so as to be provided on the upstream side of the transport path of the sheet S, that is, at a position close to the user side.

When the resistance of the sheet S is decreased and the current flows through the guide 56, determined that the resistance is decreased and equal to or lower than a threshold value set in advance, and the transfer bias may be set to the lowest state. Otherwise, an abnormal state is determined and printing is stopped, and then a message may be displayed for the user.

According to the embodiment described above, since the resistance measuring device 50 having the guide 56 is provided, when a sheet is inserted manually, even though resistance detection is performed while the user is touched by the sheet, the resistance thereof can be measured without an electric shock of the user. In addition, the transfer bias can be set on the basis of the measurement result of the resistance, so that the toner image can be transferred onto the sheet under a suitable transfer condition when the toner image is transferred onto the sheet.

Various modifications can be made without being limited to the above embodiments. For example, the bias roller 51 may also be used as a transport unit that transports a sheet S to the transfer unit.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image carrier which is illuminated with a laser beam and on which an electrostatic latent image is formed;

a charging device which charges the image carrier;

a developing device which supplies a developer to the image carrier;

a transfer device which transfers a toner image formed on the image carrier by the developing device onto a recording medium;

a manual tray through which the recording medium is manually fed to the image forming apparatus;

a resistance measuring device which causes a current to flow through the recording medium before transferring the toner image and measures a resistance of the recording medium;

a setting unit which sets conditions of the transfer on the basis of the measurement result of the resistance of the recording medium;

an electric shock prevention member which prevents the current from flowing to a user through the recording medium during the measurement of the resistance of the recording medium, the electric shock prevention member includes a conductive guide which is in contact with the recording medium and the guide is provided on an interior side 180 mm or more from an entrance opening of the manual tray; and a fixing device which fixes the toner image onto the recording medium onto which the toner image is transferred.

2. The apparatus of claim 1, wherein the resistance measuring device includes a resistance detecting unit provided in a transport path of the recording medium, and the electric shock prevention member is provided on an upstream side of the resistance detecting unit in the transport path, and the guide is grounded.

3. The apparatus of claim 2, wherein the resistance detecting unit includes:

a first roller and a second roller that opposes the first roller, the first roller and the second roller interposing the recording medium therebetween;

a bias source which causes a constant current to flow to a reference potential point through the first roller and the second roller; and a calculation unit which obtains the total resistance between the bias source and the reference potential point, and calculates the resistance of the recording medium on the basis of a difference between the total resistance obtained when the recording medium is present between the first roller and the second roller and the total resistance obtained when there is no recording medium therebetween.

4. The apparatus of claim 3, wherein the guide is provided on the upstream side of the transport path at a distance set in advance from the first roller.

5. A resistance measuring device of a recording medium in an image forming apparatus comprise a manual tray through which the recording medium is manually fed to the image forming apparatus, comprising:

a resistance detecting unit which measures a resistance of a recording medium by causing a current to flow through the recording medium before a toner image formed on an image carrier is transferred onto the recording medium; and an electric shock prevention member which prevents the current from flowing to the user through the recording medium during the measurement of the resistance of the recording medium, the electric shock prevention member includes a conductive guide which is in contact with the recording medium and the guide is provided on an interior side 180 mm or more from an entrance opening of the manual tray.

6. The device of claim 5, wherein the resistance detecting unit is provided in a transport path of the recording medium, and the resistance detecting unit includes:

a first roller and a second roller that opposes the first roller, the first roller and the second roller interposing the recording medium therebetween;

a bias source which causes a constant current to flow to a reference potential point through the first roller and the second roller; and a calculation unit which obtains the total resistance between the bias source and the reference potential point, and calculates the resistance of the recording medium on the basis of a difference between the total resistance obtained when the recording medium is present between the first roller and the second roller and the total resistance obtained when there is no recording medium therebetween.

7. The device of claim 5, wherein the electric shock prevention member is provided on an upstream side of the resistance detecting unit in the transport path, and the guide is grounded.

8. The device of claim 7, wherein the guide is provided on the upstream side of the transport path at a distance set in advance from the first roller.

9. A resistance measuring method of a recording medium in an image forming apparatus comprise a manual tray through which the recording medium is manually fed to the image forming apparatus, comprising:

measuring a resistance of the recording medium by causing a current to flow through the recording medium before a toner image formed on an image carrier is transferred onto the recording medium; and bypassing the current that flows to the user through the recording medium through an electric shock prevention member includes a conductive guide which is in contact with the recording medium during the measurement of the resistance of the recording medium, and providing the guide on an interior side 180 mm or more from an entrance opening of the manual tray.

10. The method of claim 9, wherein a resistance detecting unit which measures the resistance is provided in a transport path of the recording medium, and the resistance detecting unit includes a first roller and a second roller that opposes the first roller, interposing the recording medium between the first roller and the second roller, causes a constant current to flow to a reference potential point through the first roller and the second roller from a bias source, obtains the total resistance between the bias source and the reference potential point, and calculates the resistance of the recording medium on the basis of a difference between the total resistance obtained when the recording medium is present between the first roller and the second roller and the total resistance obtained when there is no recording medium therebetween.

11. The method of claim 10, wherein the electric shock prevention member is provided on an upstream side of the resistance detecting unit in a transport path in which the recording medium is transported, and the guide is grounded.

12. The method of claim 10, wherein the guide is provided on an upstream side of the transport path at a distance set in advance from the first roller.

* * * * *